US009293081B2

(12) United States Patent
Yun et al.

(10) Patent No.: US 9,293,081 B2
(45) Date of Patent: Mar. 22, 2016

(54) ORGANIC LIGHT EMITTING DISPLAY DEVICE WITH SIDE-VIEW PROTECTING FEATURE

(71) Applicant: Samsung Display Co., LTD., Yongin, Gyeonggi-Do (KR)

(72) Inventors: Young-Nam Yun, Suwon-si (KR); Kyu-Seok Kim, Yongin-si (KR)

(73) Assignee: Samsung Display Co., Ltd. (KR)

( * ) Notice: Subject to any disclaimer, the term of this patent is extended or adjusted under 35 U.S.C. 154(b) by 143 days.

(21) Appl. No.: 14/062,268

(22) Filed: Oct. 24, 2013

(65) Prior Publication Data

US 2014/0327705 A1 Nov. 6, 2014

(30) Foreign Application Priority Data

May 3, 2013 (KR) ..... 10-2013-0050233

(51) Int. Cl.

| | |
|---|---|
| ***G09G 5/02*** | (2006.01) |
| ***G09G 3/32*** | (2006.01) |
| ***G09F 9/33*** | (2006.01) |

(52) U.S. Cl.

CPC ..... *G09G 3/3225* (2013.01); *G09F 9/33* (2013.01); *G09G 3/3208* (2013.01); *G09G 2320/028* (2013.01)

(58) Field of Classification Search

CPC ..... G09G 3/3225; G09G 3/3208; G09G 2320/028; G09F 9/33

See application file for complete search history.

(56) References Cited

U.S. PATENT DOCUMENTS

2010/0220043 A1 * 9/2010 Broughton et al. ..... 345/87

FOREIGN PATENT DOCUMENTS

| | | | |
|---|---|---|---|
| KR | 10-2005-0064168 | A | 6/2005 |
| KR | 10-2009-0109168 | A | 10/2009 |
| KR | 10-2012-0013013 | A | 2/2012 |

* cited by examiner

*Primary Examiner* — Yong H Sim

(74) *Attorney, Agent, or Firm* — Innovation Counsel LLP

(57) ABSTRACT

A method of operating a light emitting, image display device that is configured to normally display to one or more viewers, a corresponding image thereof with a relatively wide viewing angle and relatively good contrast, includes selectively outputting to one or more peripheral portions of the wide viewing angle, privacy-protecting light rays of sufficient luminance to substantially reduce, for corresponding viewers viewing from the respective one or more peripheral portions of the relatively wide viewing angle, the otherwise normal and relatively good contrast of the image so as to thereby inhibit viewing of the image from the respective one or more peripheral portions. In one embodiment, the method is carried out using an organic light emitting diode (OLED) panel and a light source part disposed on a backside of the OLED panel and comprising at least one light guide plate and at least one light source.

18 Claims, 4 Drawing Sheets

ORGANIC LIGHT EMITTING DISPLAY DEVICE WITH SIDE-VIEW PROTECTING FEATURE

PRIORITY STATEMENT

This application claims priority under 35 U.S.C. §119 to Korean Patent Application No. 10-2013-0050233, filed on May 3, 2013 in the Korean Intellectual Property Office (KIPO), the contents of which application are herein incorporated by reference in its entirety.

BACKGROUND

1. Field

The present disclosure of invention relates to an organic light emitting display device. More particularly, the present teachings relate to an organic light emitting display device capable of controlling when a wide viewing angle thereof is available or not.

2. Description of Related Technology

An organic light emitting display device (OLEDD) is an active type thin (e.g., flat) panel display apparatus capable of displaying an image using a plurality of organic light emitting diodes (OLED's) each of which emits light itself. Because of this, the conventional organic light emitting display device works without a backlight. The organic emitting display device may have a variety of advantages such as a rapid response rate, a relatively thin thickness, an excellent color reproduction characteristics and low power consumption.

In particular, one of the advantages of the typical organic light emitting display device is that it has a good, wide viewing angle such that persons situated to a side of, rather than facing head on toward the screen, can easily see what is being displayed over the wide viewing angle. However, this general purpose advantage of the organic light emitting display device that is provided with a good wide viewing angle may at times be a disadvantage if it exposes private information to persons who are not intended to see the same. For example, an authorized user might be using an OLEDD-based laptop computer while seated in an airplane or in other crowded seating situations and may not want nearby strangers to easily see what is being displayed on his or her screen. Thus, in situations such as this, it may be advantageous to have an organic light emitting display device including a selectively evocable privacy protection structure, such as a veil view structure, capable of selectively protecting private information or preserving data of users.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

Exemplary embodiments of the present disclosure of invention provide an organic light emitting display device (OLEDD) capable of selectively controlling a viewing angle thereof including selectively reducing the viewing angle for sake of privacy protection or data preservation of users.

According to the present teachings, an organic light emitting display device includes an organic light emitting diodes display (OLEDD) panel and a light source part disposed to project privacy-protecting light rays from a backside of the OLEDD panel. In one embodiment, the privacy-protecting light rays sourcing part includes at least one a light guide plate and at least one light source.

In an exemplary embodiment, one or more light sources may be disposed between two or more spaced apart light guide plates.

In an exemplary embodiment, the light sources may include at least one of a semiconductive light emitting diode (LED), an organic light emitting diode (OLED), a cold cathode fluorescent lamp (CCFL) or an external-electrode fluorescent lamp (EEFL).

In an exemplary embodiment, the organic light emitting display device may further include a wiring part disposed between the light guide plate and the light source and including wirings that electrically connect between the OLED panel and the light source.

In an exemplary embodiment, the light source may be disposed between a corresponding light guide plate and a corresponding portion of the wiring part.

In an exemplary embodiment, the light source part may further include a first light guide plate and a spaced apart second light guide plate.

In an exemplary embodiment, the first and the second light guide plate may be integrally combined on, or as part of a substrate with the light source and the wiring part.

In an exemplary embodiment, the light source part may include respective portions disposed at a first edge of the OLED panel and a second edge of the OLED panel opposite to the first edge of OLED panel.

In an exemplary embodiment, energizing power may be applied to the light source through a touch panel or additional switches.

In an exemplary embodiment, the light source part may be electrically connected to the OLED panel, and may be selectively energized or de-energized by user operation of the OLED panel 400.

In an exemplary embodiment, a thickness of the light guide plate may be increased gradually toward a direction of disposed the light source.

In an exemplary embodiment, the light guide plate may include a rectangular shape in a plan view.

In an exemplary embodiment, the OLED panel may emit light in a first direction, and the light source may emit light in a second direction different from the first direction.

In an exemplary embodiment, the first direction may form a viewing angle between about 0 degrees and about 60 degrees and the second direction may form a viewing angle between about 60 degrees and about 90 degrees.

According to the exemplary embodiments of the present disclosure, an organic or other such light emitting, image display device may include the light source part in a backside of the image displaying panel to control a recognition area by a user selection, thereby protecting private information or preserving data privacy of users.

BRIEF DESCRIPTION OF THE DRAWINGS

The above and other features and advantages of the present disclosure of invention will become more apparent by describing in detailed exemplary embodiments thereof with reference to the accompanying drawings, in which.

DETAILED DESCRIPTION

Figure 1:
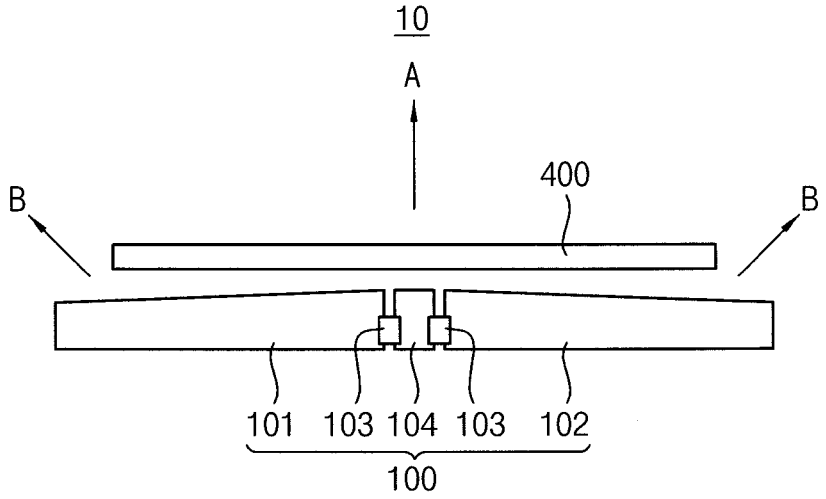
FIG. 1 is cross-sectional view illustrating an organic light emitting display device in accordance with an exemplary embodiment.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive teachings to those skilled in the art. In the drawings, the sizes and relative sizes of layers and regions may be exaggerated for clarity. Like numerals refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

Unless otherwise defined, all terms (including technical and scientific terms) used herein have the same meaning as commonly understood by one of ordinary skill in the art to which this inventive concept most closely pertains. It will be further understood that terms, such as those defined in commonly used dictionaries, should be interpreted as having a meaning that is consistent with their meaning in the context of the relevant art and the present teachings and should not be instead interpreted in an idealized or overly formal sense unless expressly so defined herein.

Hereinafter, exemplary embodiments in accordance with the present disclosure of invention will be explained in detail with reference to the accompanying drawings.

FIG. 1 is cross-sectional view illustrating an organic light emitting display device (OLEDD) having a privacy-protecting light rays sourcing part in accordance with an exemplary embodiment of the present disclosure of invention.

Referring to FIG. 1, an organic light emitting display device 10 may include an organic light emitting diode (OLED) panel 400 and a selectively activatable privacy-protecting light rays sourcing part 100 disposed behind (e.g., under) the organic light emitting diode panel 400 such that the latter can function as a shield against privacy-protecting light rays projected from the sourcing part 100 (or "light source part" 100, for short).

The light source part 100 includes a first light guide plate 101 disposed to project privacy-protecting light rays from a respective first side, a second light guide plate 102 disposed to project privacy-protecting light rays from a respective second side, a plurality of light sources 103 operatively coupled to the light guide plates (101, 102) and a wiring part 104 operatively coupled to the light sources 103.

The light source part 100 is either permanently or removably affixed to a back side of the OLED panel 400. The light source part 100 may be selectively energized by computer driven actuation through the OLED panel 400 or manually energized by a user. More specifically, a user may be provided with an additional switch or a touch panel icon for selectively activating and deactivating the light source part 100.

More specifically, the first light guide plate 101 is disposed under a left side of the OLED panel 400. The first light guide plate 101 may include an inclined upper surface inclined toward a left-side, wide angle viewing area portion of the OLED panel 400. The first light guide plate 101 may include a flat lower surface. As a result of the inclined top surface, a thickness of the first light guide plate 101 increases gradually when considering it from its outer edge and moving toward the centrally located light sources 103. The first light guide plate 101 may have a rectangular shape when viewed in top plan view. (See FIG. 3.) The first light guide plate 101 may guide light supplied from the light sources 103.

Alternatively, the first light guide plate 101 may include an inclined lower surface inclined toward the end portion of the first light guide plate 101, while the first light guide plate 101 may include a flat upper surface.

The second light guide plate 102 is disposed under a right side of the OLED panel 400. The second light guide plate 102 may include an inclined upper surface inclined toward the corresponding right-side, wide angle viewing area portion of the OLED panel 400. The second light guide plate 102 may include a flat lower surface. A thickness of the second light guide plate 102 may be increased gradually toward the light source 103. The second light guide plate 102 may have a rectangular shape when viewed in a top plan view. The second light guide plate 102 may guide light from the light sources 103.

Alternatively, the second light guide plate 102 may include an inclined lower surface inclined toward the end portion of the second light guide plate 102, while the second light guide plate 102 may include a flat upper surface.

The first light guide plate 101 and the second light guide plate 102 may include optical transmission materials such as at least one of PMMA (poly methylmethaacrylate), PC (polycarbonate), acrylic, silicon, etc.

The light sources 103 are disposed between the first light guide plate 101 and the second light guide plate 102 to serve as a light source in the organic light emitting display device 10. For example, the light source 103 may include white light emitting diodes, red light emitting diodes, green light emitting diodes, blue light emitting diodes, cold cathode fluorescent lamps, external electrode fluorescent lamps, etc.

The wiring part 104 is disposed between the first light guide plate 101 and the second light guide plate 102. The wiring part 104 may include wirings (not individually illustrated) that electrically connect the OLED panel 400 and the light sources 103.

As illustrated in FIG. 1, when power is not applied to the light source 100, the light source 100 does not emit privacy-protecting light rays. In this case, the organic light emitting display device 10 may widely display a first image both in a first direction A and in a second direction B because of the wide viewing angle properties of the OLEDD 10. The first direction A is a front direction corresponding to about 0 degree to about 60 degrees of a viewing angle from a normal plane centered in the middle of the screen. The second direction B is a side direction corresponding to about 60 degrees to about 90 degrees of a viewing angle from a normal plane centered in the middle of the screen.

A general or flexible organic light emitting diode panel may be used for the OLED panel 400.

Figure 2:
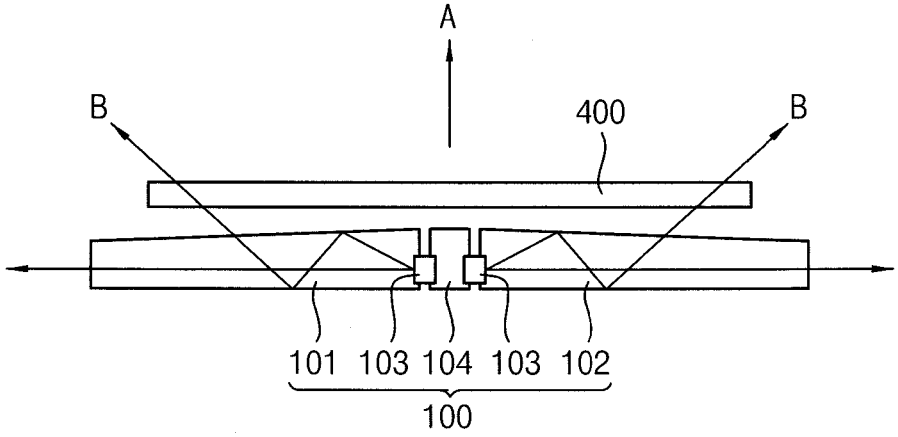
FIG. 2 is a cross-sectional view illustrating the organic light emitting display device (OLEDD) in FIG. 1 when power is applied to activate the privacy-protecting light rays sourcing part.

FIG. 2 is a cross-sectional view illustrating the organic light emitting display device in FIG. 1 when power is applied for emitting privacy-protecting light rays out of both the left and right sides.

Referring to FIG. 2, when energizing power (e.g., a supply voltage of appropriate level) is applied to the light source part 100 of the organic light emitting display device (OLEDD) 10 by a user, light rays irradiated from the light source part 100 are guided and emitted out of left and right side portions of the device 10, for example in the second directions B but in the first direction A due to light ray re-directing functions of the first light guide plate 101 and of the second light guide plate 102 and due to shielding in the A direction as provided by the back of the OLEDD 10. Accordingly, when a user drives the light source part 100 of the organic light emitting display device 10, the organic light emitting display device 10 may display only a viewable first image in the first direction A but not in the B directions. That is, when a user manually and/or by means of automatic software control, energizes part or all of the light source part 100 of the organic light emitting display device 10, a second image in the second direction B may not be viewable by persons looking along a reverse of that direction B because the privacy-protecting light rays output in the B direction prevent or substantially interfere with usable viewing along the B portions of the wide angle capabilities of the OLEDD 10. In FIG. 2, the B directed privacy-protecting light rays are drawn in schematic fashion. The left and right edges of the OLEDD 10 may be transparent or otherwise light-passing to let through the privacy-protecting light rays when the sourcing part 100 is activated, and/or the left and right edges of the light guide plates, 101 and 102, may extend beyond the left and right edges of the OLEDD 10 such that the privacy-protecting light rays are projected toward areas where viewing is to be cloaked by means of the outward extending parts of the light guide plates, 101 and 102.

Figure 3:
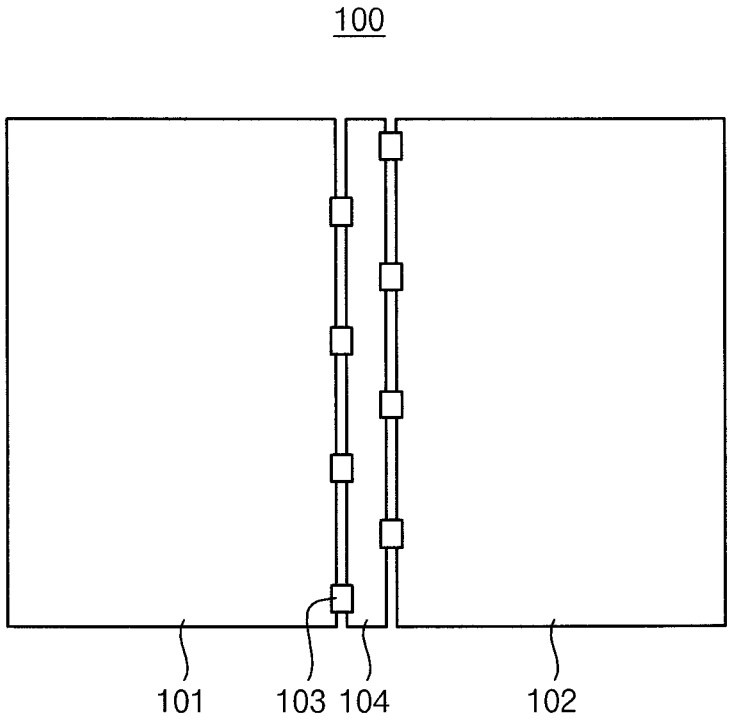
FIG. 3 is a plan view illustrating a possible layout for the organic light emitting display device in FIG. 1.

FIG. 3 is a top plan view illustrating a possible layout for the organic light emitting display device in FIG. 1.

Referring to FIG. 3, the light source part 100 of the illustrated embodiment includes a rectangle shaped first light guide plate 101, a rectangle shaped and spaced apart second light guide plate 102, a plurality of the light sources 103 disposed in the spacing between the light guide plates, and a wiring part 104 also disposed in the spacing between the light guide plates. In the illustrated embodiment, the light sources 103 are arranged alternately and distributively in an elongation direction of the wiring part 104 so as, for example, to provide for better heat dissipation than if the light sources were crowded together.

An area of the first light guide plate 101 may be greater than an area of the wiring part 104 in a plan view. An area of the second light guide plate 102 may be greater than an area of the wiring part 104 in a plan view. Alternatively, an area of the first light guide plate 101 and the second light guide plate 102 may be smaller than an area of the wiring part 104 in a plan view. The exemplary rectangular shapes of the light guide plates, 101 and 102, are merely that, namely, exemplary and in alternate embodiments, the light guide plates may have portions which interdigitate with one another such that each light source 103 can simultaneously output its light rays to both adjacent and interdigitated fingers (not shown) of the alternatively interdigitated light guide plates. In the illustrated example of FIG. 3, however, it may be assumed that the light sources 103 on the left output their respective privacy-protecting light rays only to the left side light guide plate 101 and that the light sources 103 on the right output their respective privacy-protecting light rays only to the right side light guide plate 102 whereby, in appropriate circumstances only the left or the right side light sources are activated so as to conserve power and/or allow a person only sitting on one side of the user to see what is being displayed.

Figure 4:
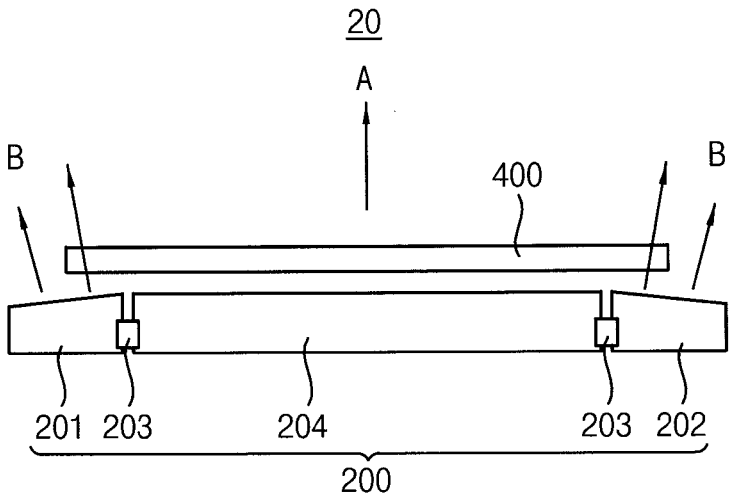
FIG. 4 is a cross-sectional view illustrating an organic light emitting display device in accordance with another exemplary embodiment.

FIG. 4 is a cross-sectional view illustrating an organic light emitting display device in accordance with another exemplary embodiment.

Referring to FIG. 4, an organic light emitting display device 20 includes a light source part 200 and an organic light emitting diodes display (OLEDD) panel 400.

The organic light emitting display device 20 is substantially the same as or similar to the organic light emitting display device 10 illustrated in FIG. 1 except for a detailed structuring of the light source part 100. Thus, detailed descriptions of like elements will not be repeated herein.

The light source part 200 includes a first light guide plate 201, a second light guide plate 202, a light source 203 and a wiring part 204.

The light source part 200 is electrically connected to the OLEDD panel 400. The light source part 200 is selectively driven by a user (or by automated software) through the OLEDD panel 400. A user may provide activating input through additional switches or a touch panel or various software actuations to drive the light source part 200 and thus activate part or all of the privacy-protecting light rays sourcing functions of the light source part 200.

The first light guide plate 201 is disposed under a left side of the OLED panel 400. The first light guide plate 201 may include an inclined upper surface inclined toward an end portion of the first light guide plate 201. The first light guide plate 201 may include a flat lower surface. A thickness of the first light guide plate 201 may be increased gradually toward the light source 203. The first light guide plate 201 may have a rectangular shape when viewed in a top plan view. The first light guide plate 201 may serve to guide light from the light source 203.

Alternatively, the first light guide plate 201 may include an inclined lower surface inclined toward of the end portion of the first light guide plate 201, while the first light guide plate 201 may include a flat upper surface.

The second light guide plate 202 is disposed under a right side of the OLED panel 400. The second light guide plate 202 may include an inclined upper surface inclined toward an end portion of the second light guide plate 202. The second light guide plate 202 may include a flat lower surface. A thickness of the second light guide plate 202 may be increased gradually toward the light source 203. The second light guide plate 202 may have a rectangular shape when viewed in plan view. The second light guide plate 202 may serve to guide light from the light source 203.

Alternatively, the second light guide plate 202 may include an inclined lower surface inclined toward the end portion of the second light guide plate 202, while the second light guide plate 202 may include a flat upper surface.

The first light guide plate 201 and the second light guide plate 202 may be composed of appropriate optics transmission materials such as for example including at least one of PMMA (poly methylmethaacrylate), PC (polycarbonate), acrylic, silicon, etc.

The light source 203 is disposed between the first light guide plate 201 and the second light guide plate 202, and serves as a light source in the organic light emitting display device 20.

The wiring part 204 may electrically connect the OLED panel 400 and the light source 203. An area of the wiring part 204 may be larger than an area of the first light guide plate 201 in a plan view. An area of the wiring part 204 may be larger than an area of the second light guide plate 202 in a plan view. The light source part 203 and the wiring part 204 may be integrally connected with each other. More specifically, the electrical conductors (not shown) of the wiring part 204 may be monolithically integrated onto a same substrate on which the light sources 203 (e.g., LED's, OLED's) are mounted and the substrate may integrally provide the light guide plate functions or have appropriate light guide plates also mounted to it.

Figure 5:
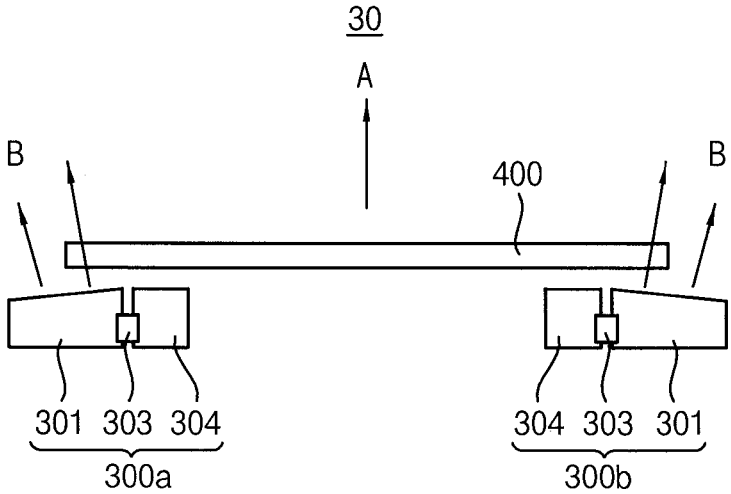
FIG. 5 is a cross-sectional view illustrating an organic light emitting display device in accordance with still another exemplary embodiment.

FIG. 5 is a cross-sectional view illustrating an organic light emitting display device in accordance with still another exemplary embodiment of the present disclosure of invention.

Referring to FIG. 5, an organic light emitting display device 30 includes a plurality of light source parts 300*a*, 300*b* and an organic light emitting diode (OLED) panel 400.

The organic light emitting display device 30 is substantially the same as or similar to the organic light emitting display device 10 illustrated in FIG. 1 except for a specific structuring of the light source parts 300 into a plurality of spaced apart light source parts 300*a*, 300*b*. Thus, detailed descriptions of like elements will not be repeated herein.

In this embodiment, a plurality of the light sources parts may be disposed under both sides of the OLED panel 400. A first light source part 300*a* may be disposed under a left side of the OLED panel 400. A spaced apart and second light source part 300*b* may be disposed under a right side of the OLED panel 400.

Each of the light source parts 300*a*, 300*b* includes a respective light guide plate 301, a respective plurality of light sources 303 and a respective wiring part 304.

The light source part 300 is electrically connected to the OLED panel 400. The light source part 300 is selectively driven by a user through the OLED panel 400. A user may input through additional switches or a touch panel to drive the light source part 100.

A light guide plate 301 is disposed under the OLED panel 400. The light guide plate 301 may have an inclined upper surface inclined toward an end portion of the first light guide plate 301. The first light guide plate 101 may include a flat lower surface. The light guide plate 301 may include as its optical transmission materials, at least one of PMMA (poly methylmethaacrylate), PC (polycarbonate), acrylic, silicon, etc. A thickness of the light guide plate 301 may be increased gradually toward the light sources 303. The light guide plate 301 may have a rectangular shape in plan view. The light guide plate 301 may serve to guide light from the light source 303.

Alternatively, the light guide plate 301 may have an inclined lower surface inclined toward the end portion of the light guide plate 301, while the light guide plate 301 may have a flat upper surface.

A plurality of the light sources 303 is connected to the light guide plate 301, and serves as a light source in the organic light emitting display device 30.

The wiring part 304 provides a pathway for wirings that connect the light source 303 and the OLED panel 400. An area of the wiring part 304 may be larger than an area of the light guide plate 301 in a plan view. Alternatively, an area of the light guide plate 301 may be larger than an area of the wiring part 304. In this embodiment, the light source 303 is disposed between the light guide plate 301 and the wiring part 304. The wiring part 304 may electrically connect the OLED panel 400 and the light source 303.

Figure 6:
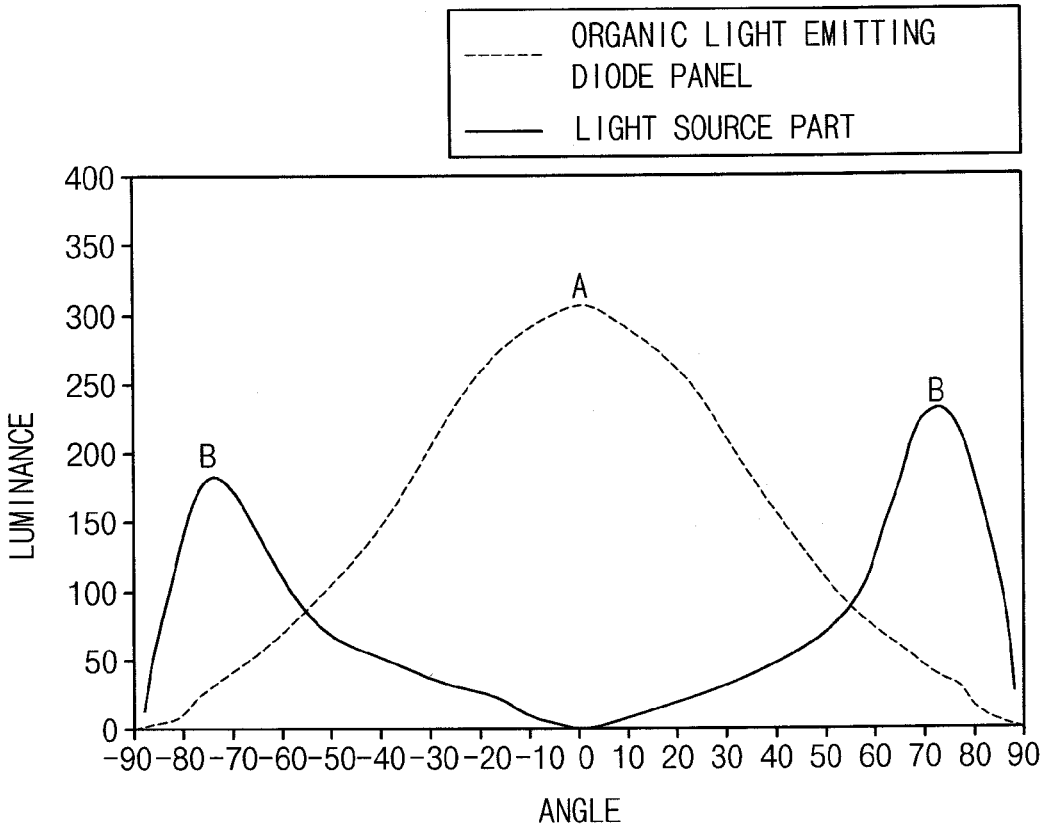
FIG. 6 is a graph illustrating a relationship between a viewing angle and luminance of the organic light emitting display device in FIG. 1.

FIG. 6 is a graph illustrating a relationship between a viewing angle and luminance of the organic light emitting display device in FIG. 1.

Referring to FIG. 6, when energizing power (e.g., a voltage) is applied to a respective portion of or all of the light source part 100, a perceived luminance of the organic light emitting display device varies depending on a viewing angle. Here the X axis represents a viewing angle and the Y axis represents luminance curves due to the output light rays of the organic light emitting diodes panel 400 and the light source part 100. The luminance of the organic light emitting diodes panel 400 in the first direction A, which is a viewing direction within about 0 degree and about 60 degrees, is about 300 (as measured in appropriate luminance representing units). When the organic light emitting display device is viewed on the front side in the first direction A, the luminance of the organic light emitting diode panel 400 is greater than the luminance of the light source part 100, so that the contrast ratio of the projected image is not decreased (not interfered with by the simultaneous outputting of the privacy-protecting light rays from the sourcing part 100). Therefore, a user may recognize an image displayed on the organic light emitting diode panel 400 in the first direction A. However, when the organic light emitting display device is viewed in the second direction B, which is a viewing direction within about 60 degree and about 90 degree, the luminance of the organic light emitting diode panel 400 is smaller than the luminance of the light source part 100, and if the viewer's eyes shrink their pupil size to accommodate for increased luminance, the contrast ratios within the image portion of the light rays that a person (viewer) facing in the B area sees, may be substantially decreased. Therefore, it is difficult for a user in the B facing area to recognize an image displayed on the organic light emitting diode panel 400 in the second direction B because the image is washed out by the greater luminance of the privacy-protecting light rays output from the sourcing part.

According to exemplary embodiments of the present disclosure of invention, an organic light emitting display devices may include the light source part in a backside of the organic light emitting diode panel to control a recognition area by a user selection, thereby protecting private information.

The foregoing is illustrative of the present disclosure of invention and is not to be construed as limiting thereof. Although a few exemplary embodiments in accordance with the present disclosure have been described, those skilled in the art will readily appreciate in light of the foregoing that many modifications are possible without materially departing from the novel teachings and advantages of the present disclosure of invention. Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. A light emitting, image display device comprising:

a display panel configured to emit image-displaying light rays to display to one or more viewers a corresponding image thereof with a relatively wide viewing angle and relatively good contrast; and a privacy-protecting light rays sourcing part that is separated from the display panel and configured to output into one or more peripheral portions of the relatively wide viewing angle, privacy-protecting light rays of sufficient luminance to substantially reduce, for corresponding viewers viewing from the respective one or more peripheral portions of the relatively wide viewing angle, the otherwise normal and relatively good contrast of the image as viewed from the respective one or more peripheral portions so as to thereby inhibit viewing of the image from the respective one or more peripheral portions, wherein the privacy-protecting light rays are separate from the image-displaying light rays displaying the image.

2. A light emitting, image display device configured to normally display to one or more viewers, a corresponding image thereof with a relatively wide viewing angle and relatively good contrast, the light emitting, image display device comprising:

a privacy-protecting light rays sourcing part configured to output into one or more peripheral portions of the relatively wide viewing angle, privacy-protecting light rays of sufficient luminance to substantially reduce, for corresponding viewers viewing from the respective one or more peripheral portions of the relatively wide viewing angle, the otherwise normal and relatively good contrast of the image as viewed from the respective one or more peripheral portions so as to thereby inhibit viewing of the image from the respective one or more peripheral portions;

an organic light emitting diodes (OLED) panel, and wherein the sourcing part is disposed on a backside of the OLED panel and comprises one or more light guide plates and one or more light sources.

3. The light emitting image display device of claim 2, wherein there are at least two spaced apart light guide plates and at least one of the one or more light sources is disposed between the at least two spaced apart light guide plates.

4. The light emitting image display device of claim 2, wherein the one or more light sources comprise at least one light source selected from the group consisting of a semiconductive light emitting diode (LED), an organic light emitting diode (OLED), a cold cathode fluorescent lamp (CCFL) and an external electrode fluorescent lamp.

5. The light emitting image display device of claim 2, further comprising a wiring part disposed between at least one of the one or more light guide plates and at least one of the light sources, the wiring part comprising wirings that provide electrical connection between the OLED panel and the one or more light sources.

6. The light emitting image display device of claim 5, wherein at least one of the light sources is disposed between a corresponding light guide plate and the wiring part.

7. The light emitting image display device of claim 2, wherein the light source part comprises a first light guide plate and a spaced apart second light guide plate.

8. The light emitting image display device of claim 7, wherein the first and second light guide plates are part of an integrated structure that is integrally combined with the one or more light sources and the wiring part.

9. The light emitting image display device of claim 2, wherein the sourcing part comprises: a first light source part disposed under a first edge of the OLED panel; and a second light source part disposed under a second edge of the OLED panel opposite to the first edge of OLED panel.

10. The light emitting image display device of claim 2, further comprising a selective power applying circuit configured to selectively apply energizing power to at least one of the light sources in response to at least one of a user actuation of a touch panel area or a switch or a software-driven automated process that automatically determines that privacy-protection is warranted.

11. The light emitting image display device of claim 2, wherein the sourcing part is electrically connected to the OLED panel, and selectively driven by a user through the OLED panel.

12. The light emitting image display device of claim 2, wherein a thickness of the light guide plate is increased gradually toward the light source.

13. The light emitting image display device of claim 2, wherein the light guide plate has a rectangular shape in a plan view.

14. The light emitting image display device of claim 2, wherein the OLED panel emits light in a first direction, and the light source emits light in a second direction different from the first direction.

15. The light emitting display device of claim 14, wherein the first direction forms a viewing angle between about 0 degrees and about 60 degrees and the second direction forms a viewing angle between about 60 degrees and about 90 degrees.

16. A method of operating a light emitting, image display device, the method comprising:

operating a display panel to emit image-displaying light rays to display to one or more viewers a corresponding image thereof with a relatively wide viewing angle and relatively good contrast; and operating a privacy-protecting light rays sourcing part that is separate from the display panel and to selectively output to one or more peripheral portions of the relatively wide viewing angle, privacy-protecting light rays of sufficient luminance to substantially reduce, for corresponding viewers viewing from the respective one or more peripheral portions of the relatively wide viewing angle, the otherwise normal and relatively good contrast of the image as viewed from the respective one or more peripheral portions so as to thereby inhibit viewing of the image from the respective one or more peripheral portions, wherein the privacy-protecting light rays are separate from the image-displaying light rays displaying the image.

17. The method of claim 16, wherein the light emitting, image display device includes an organic light emitting diodes (OLED) panel and the sourcing part disposed on a backside of the OLED panel and the method uses a backside portion of the OLED panel to shield the privacy-protecting light rays from a viewer who is viewing the OLED panel from a direct facing portion of the relatively wide viewing angle.

18. The method of claim 16, wherein the selective outputting to one or more peripheral portions of the relatively wide viewing angle, of the privacy-protecting light rays is in response to at least one of a user actuation of a privacy evoking physical or GUI switch and a software driven automatic process.

* * * * *